US006691547B2

(12) United States Patent
Cutshall et al.

(10) Patent No.: US 6,691,547 B2
(45) Date of Patent: Feb. 17, 2004

(54) METHOD OF DOING BUSINESS AND MANUFACTURING IN A STAMPING AND EXTRUSION FACILITY

(75) Inventors: Mark L. Cutshall, Plymouth, MI (US); Wallace E. Smith, Novi, MI (US)

(73) Assignee: E & E Manufacturing Company, Inc., Plymouth, MI (US)

( * ) Notice: Subject to any disclaimer, the term of this patent is extended or adjusted under 35 U.S.C. 154(b) by 0 days.

(21) Appl. No.: 10/027,434

(22) Filed: Dec. 21, 2001

(65) Prior Publication Data

US 2003/0115926 A1 Jun. 26, 2003

(51) Int. Cl.[7] ..... B21D 22/00; B21D 43/00
(52) U.S. Cl. ..... 72/404; 72/413; 705/500
(58) Field of Search ..... 72/404, 446, 448, 72/413, 339; 483/14, 15; 705/500

(56) References Cited

U.S. PATENT DOCUMENTS 2,421,457 A * 6/1947 Lindsay ..... 72/446
3,314,271 A 4/1967 Otis
3,576,540 A * 4/1971 Fair et al. ..... 700/9
3,942,354 A * 3/1976 Randolph, Sr. ..... 72/448
4,143,574 A * 3/1979 Ryser et al. ..... 72/336
4,151,736 A * 5/1979 Quaas ..... 72/446
4,151,976 A 5/1979 Schurman
4,160,372 A * 7/1979 Bergman et al. ..... 72/404
4,166,372 A * 9/1979 Knight ..... 72/348
4,656,861 A * 4/1987 Koyama et al. ..... 72/446
4,733,552 A * 3/1988 Lefils ..... 72/405.06
5,007,275 A 4/1991 Voss
5,054,188 A * 10/1991 Sabado ..... 72/339
5,374,231 A * 12/1994 Obrist ..... 483/15
5,401,229 A * 3/1995 Otsuka et al. ..... 483/15
6,185,476 B1 2/2001 Sakai

* cited by examiner

*Primary Examiner*—Daniel C. Crane
(74) *Attorney, Agent, or Firm*—Brooks Kushman P.C.

(57) ABSTRACT

A method of manufacturing a stamped, extruded finished part includes permanently attaching upper and lower shoes to a moveable ram and a stationary bolster plate of a dedicated stamping press. A replaceable extrusion die sub-assembly is mounted between the upper and lower shoes for extruding a workpiece into a preform. A component die sub-assembly is replaceably attached to the ram and bolster plate of the press for processing the preform into the finished part. The workpiece is progressively extruded then stamped into the finished part. Only the component die sub-assembly and the perishable components of the extrusion die sub-assembly are replaced when a different finished part is ordered.

8 Claims, 6 Drawing Sheets

METHOD OF DOING BUSINESS AND MANUFACTURING IN A STAMPING AND EXTRUSION FACILITY

BACKGROUND OF THE INVENTION

1. Field of the Invention

The present invention relates to a method of manufacturing a stamped part having extrusions, and an apparatus for manufacturing the part.

2. Background Art

The use of drawn structural extrusions as a means to reduce the cost of a finished part, particularly a stamped part, is well known. Typically these parts do not have the thickness of material required for the forming of threads, which would allow the part to be bolted directly into place. Attempts to solve this problem include the use of a separate fastener such as a threaded nut, or attaching additional material to the part in the area to be threaded—e.g., using a weld nut. A better alternative is to extrude and thread the part itself, thereby eliminating the cost of the additional components, and the cost of attaching the components.

Despite the overall cost benefit associated with extruding a stamped part, the extruding process itself remains a specialty. A great deal of expertise and experience is required to ensure that the extrusion that is formed is capable of being threaded and is strong enough to meet the customer's structural requirements. In addition, extruding a stamped component can significantly increase the processing cost. Two separate die assemblies are required: an extrusion die, which forms the extrusions, and a component die, which is used to form the workpiece into the finished part. Typically the extrusion die and the component die are part of the same die assembly. This significantly increases the size of the die assembly, which not only increases the cost of handling the die assembly within the processing facility, but also creates logistical problems and increases costs when the die assembly is transported to or from the customer's facility. This further limits the number of processing facilities that can perform this type of extrusion work. Not only must the processor have the requisite level of skill, but facilities and equipment capable of handling extremely large die assemblies must also be available.

One method used to overcome some of the problems associated with handling these larger die assemblies is to "split" the die between the extrusion and component portions. This has the advantage of making the die assembly easier to handle and less costly to transport; however, this method has inherent limitations of its own. Specifically, this type of "die splitting" increases the engineering costs associated with the design of the die assembly. Splitting the die makes it necessary to design two portions that can be separately attached to a press, and are capable of being properly aligned with one another once they are installed on the press. Additional costs are then incurred each time the die assembly is attached to the press, since the alignment of the extrusion portion and the component portion is critical. Therefore, neither of the two methods—using a single, extremely heavy but complete die assembly, or splitting the die and dealing with critical alignment issues—eliminates the problems inherent in the extrusion process.

Accordingly, it is desirable to provide a method of extruding a stamped part which overcomes the above referenced shortcomings of prior art methods, by reducing the cost of the extrusion process and at the same time eliminating the need to maneuver and transport extremely heavy die assemblies.

SUMMARY OF THE INVENTION

The present invention provides a method of manufacturing a stamped part with extrusions, such that the net costs to both the processor and the customer are reduced, and at the same time the ability to maneuver and transport the die assemblies is greatly increased. The present invention also provides for a method of doing business which utilizes the manufacturing method such that sales are increased and costs are lowered. Further provided in the present invention is an apparatus to be used in the manufacturing method.

Specifically, the manufacturing method dedicates a stamping press with a moveable ram and a stationary bolster plate to a particular set of finished parts. Each part in the set has extrusions that are similarly configured. Permanently attached to the ram and bolster plate of the press are upper and lower shoes that are configured to cooperate with replaceable die subassemblies.

The upper and lower shoes are weldments that are assembled prior to being permanently mounted on the stamping press. Each shoe comprises a plurality of nitrogen cylinders mounted between two sub-plates that are welded to a plurality of vertical support members. Once the shoes are assembled, the upper shoe is attached to the movable ram on the press, and the lower shoe is attached to the stationary bolster plate opposite the upper shoe.

An extrusion die sub-assembly is then assembled and configured for use with more than one type of finished part. Use of the extrusion die sub-assembly will result in some of its components, known as perishables, becoming worn and requiring replacement. However, the extrusion die sub-assembly itself is only replaced when the finished part changes significantly, such as when a finished part from a new product line is ordered. In a preferred embodiment, the extrusion die sub-assembly is assembled from components which are, to the extent possible, standard in both size and shape. This significantly reduces the cost of the extrusion die sub-assembly, by allowing the components to be purchased and/or manufactured in bulk quantities.

The method further requires the assembly of a component die subassembly designed to meet the customer's finished part specifications. The extrusion die sub-assembly is mounted to the upper and lower shoes, and the component die sub-assembly is directly mounted to the ram and bolster plate of the press. The two die sub-assemblies are then mounted in such a way they can be easily removed. Typically, the extrusion die sub-assembly is removed to replace its perishable components, and the component die-subassembly is completely replaced when a new finished part is ordered. A workpiece is fed into the stamping press where it is first extruded into a preform, and then formed into the finished part. The actual processing of the workpiece resembles a standard progressive die stamping process.

The business method utilizes the manufacturing method of the present invention to benefit both the manufacturer and the customer. A standard stamping operation does not utilize upper and lower shoes permanently attached to the press. Rather, only portions of the shoes are used in a standard operation, and these are part of the tooling costs paid for by the customer. Typical tooling costs include the cost of the extrusion die set and the component die set. Each time the customer orders a different finished part, new tooling is purchased. Hence, the cost of at least a portion of the shoes is a reoccurring cost for the customer-one that is often significant. In contrast to a standard operation, the present business method designates the shoes as capital equipment. This means that the stamping facility now bears this cost, but amortizes it over a long period of time. The net cost to the stamping facility is negligible compared to the increase in business resulting from significantly lowering customer tooling costs. As an alternative, the capitalized cost of the shoes can be added into the price charged for a finished part. This additional cost to the customer is minimal, since the same shoes are used for many different finished parts. Moreover, the same shoes can be used for parts made for different customers, further reducing the cost to an individual customer. Either method results in a net cost savings to the customer.

The business method also includes standardizing extrusion configurations in such a way that the needs of most customers are met by using one of the standard configurations. Further, performance and dimensional data for the standard configurations are published and made available to the customers. This allows the customers to have before them all the information they need to make an informed decision regarding the extrusions they choose for their parts. In addition, this allows the stamping facility to assemble standard extrusion die sub-assemblies from standard parts inventoried in bulk. This results in a net savings to both the customer and the stamping facility. Hence, capitalizing the upper and lower shoes, standardizing the extrusion configurations, and following the steps of the manufacturing method, results in a business method which benefits both the manufacturer and the customer.

Accordingly, one aspect of the present invention provides an improved method of manufacturing a customer's finished part such that costs to both the manufacturer and the customer are reduced.

One aspect of the invention is a method of manufacturing a finished part to a customer's specifications using a stamping press having upper and lower shoes. The method comprises attaching the upper shoe to a moveable ram of the press, and attaching the lower shoe to a stationary bolster plate of the press, the shoes being configured to cooperate with replaceable die sub-assemblies. An extrusion die sub-assembly is assembled and configured to extrude a workpiece into a preform for the finished part. This die sub-assembly is then replaceably attached to the upper and lower shoes. A component die sub-assembly is assembled based on the customer's finished part specifications. The component die sub-assembly is then replaceably attached to the ram and bolster plate of the press. Finally, a workpiece is fed into the stamping press where it is progressively formed: first by extruding it into a preform with the extrusion die sub-assembly, then by forming it into the finished part with the component die sub-assembly.

Another aspect of the invention is a method of doing business in a stamping facility whereby net costs are lowered for the stamping facility and its customers. The business method comprises capitalizing an upper shoe attached to a moveable ram of a press, and capable of cooperating with replaceable die subassemblies. Further, a lower shoe attached to a stationary bolster plate opposite the movable ram on press is also capitalized. Capitalizing the shoes removes their cost from the customer tooling by having the stamping facility bear the initial cost. Capitalizing the shoes also includes amortizing their cost over time, such that the cost is spread over many different finished parts. The business method further comprises standardizing extrusion configurations and inventorying a variety of different die components adapted to make the standard configurations. An extrusion die sub-assembly is assembled using at least some of the inventoried components; it is then replaceably attached to the upper and lower shoes. A component die subassembly is assembled based on the customer's finished part specifications; it is then replaceably attached to the ram and bolster plate of the press. Finally, the customer's finished part is manufactured by feeding a workpiece into the stamping press where it is first extruded into a preform by the extrusion die sub-assembly, and then formed into the finished part by the component die sub-assembly.

It is another aspect of the present invention to provide a modular progressive stamping die assembly which comprises a stamping press having a moveable ram for imparting a stamping force to a workpiece, and a stationary bolster plate located opposite the moveable ram. An upper shoe is attached to the ram and a lower shoe is attached to the bolster plate. Both shoes are capable of cooperating with replaceable die sub-assemblies. An extrusion die sub-assembly, replaceably attached to the upper and lower shoes, is configured to extrude the workpiece into a preform for a finished part. A component die sub-assembly, replaceably attached to the ram and bolster plate of the press in a position to receive the preform from the extrusion die sub-assembly, is configured to form the preform into at least a near net shape.

The above object and other objects, features, and advantages of the present invention are readily apparent from the following detailed description of the best modes for carrying out the invention when taken in connection with the accompanying drawings.

DETAILED DESCRIPTION OF THE PREFERRED EMBODIMENTS

Figure 1:
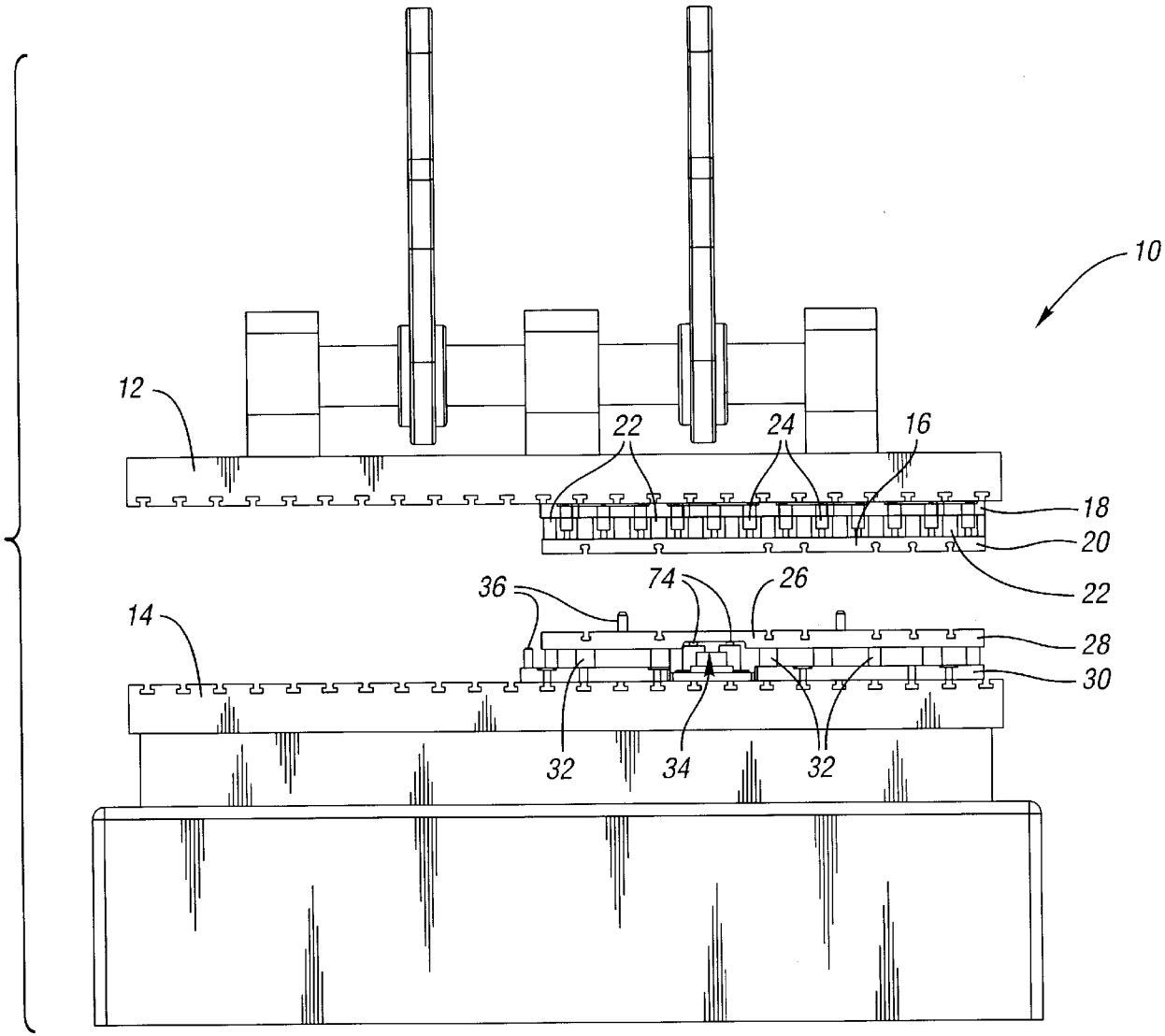
FIG. 1 shows a front view of stamping press with upper and lower shoes attached.

FIG. 1 shows a front view of a stamping press 10 having a moveable ram 12 and stationary bolster plate 14. Attached to the ram 12 of the press 10 is an upper shoe 16. The upper shoe 16 includes sub-plates 18 and 20 that are welded to a plurality of vertical support members 22. Also included in the upper shoe 16 is a plurality of nitrogen cylinders 24. The nitrogen cylinders 24 act as springs to strip a workpiece from extrusion tooling shown in detail in FIG. 3. Attached to the bolster plate 14 is a lower shoe 26 which includes sub-plates 28 and 30 welded to vertical support members 32. The lower shoe 26 also includes a plurality of nitrogen cylinders 34 and a plurality of locating pins 36 that are used to accurately mount replaceable die sub-assemblies. The nitrogen cylinders 34 also aid in the removal of the workpiece from extrusion tooling shown in detail in FIG. 4.

Figure 2:
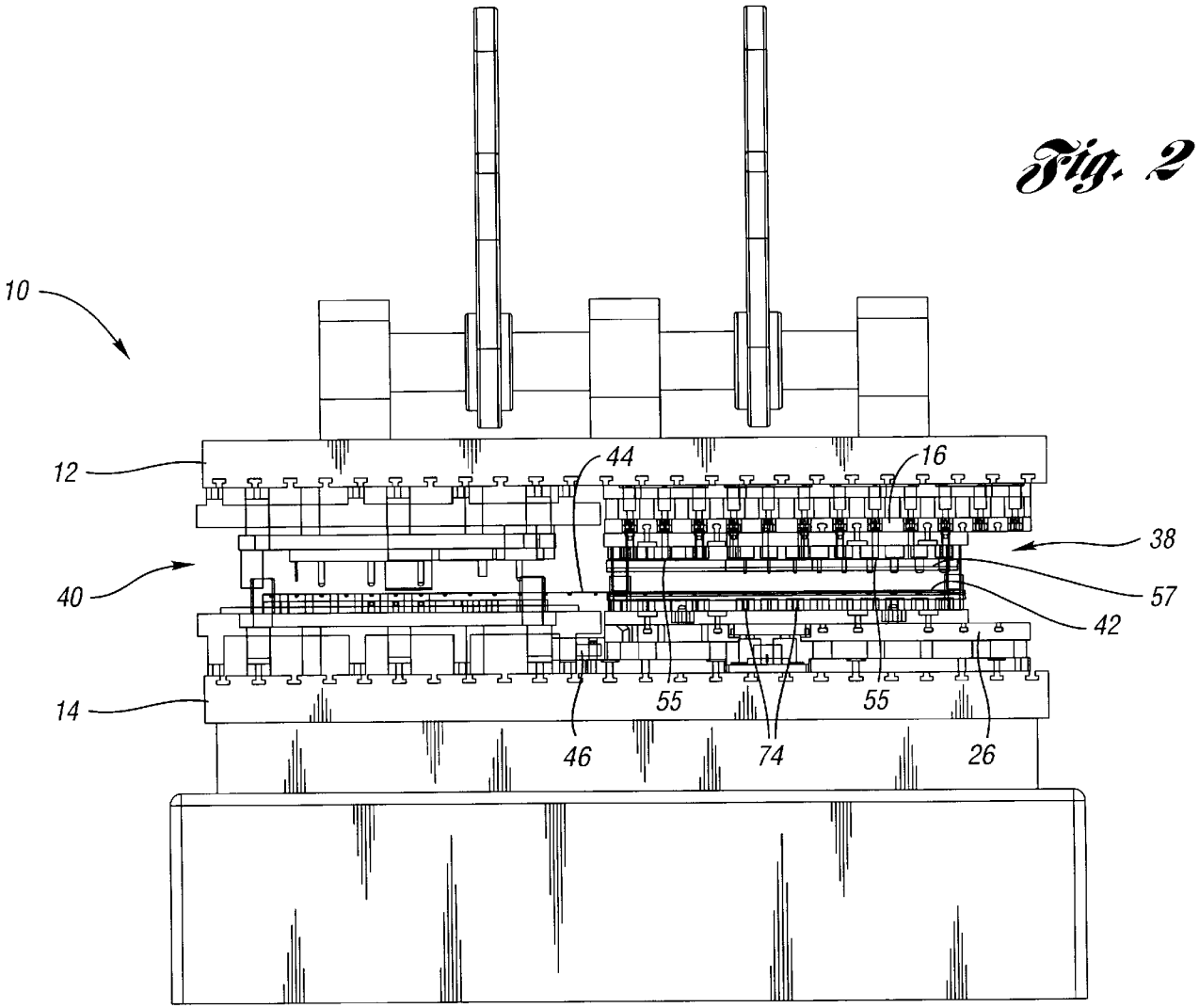
FIG. 2 shows a front view of the stamping press with an extrusion die sub-assembly and a component die sub-assembly attached to the press.

FIG. 2 shows a front view of the stamping press 10 with the extrusion die sub-assembly 38 mounted between the upper and lower shoes 16, 26, and a component die subassembly 40 mounted between the ram 12 and the bolster plate 14. The extrusion die sub-assembly 38 includes perishable tooling 42 which is shown in greater detail in FIGS. 3 and 4. Also shown in FIG. 2 is the workpiece 44 feeding into the component die sub-assembly 40 from the extrusion die sub-assembly 38. An alignment bar 46 provides a link between the extrusion die sub-assembly 38 and the component die sub-assembly 40. The alignment bar 46 ensures that the two die sub-assemblies 38, 40 are properly aligned when they are mounted on the stamping press 10.

Figure 3:
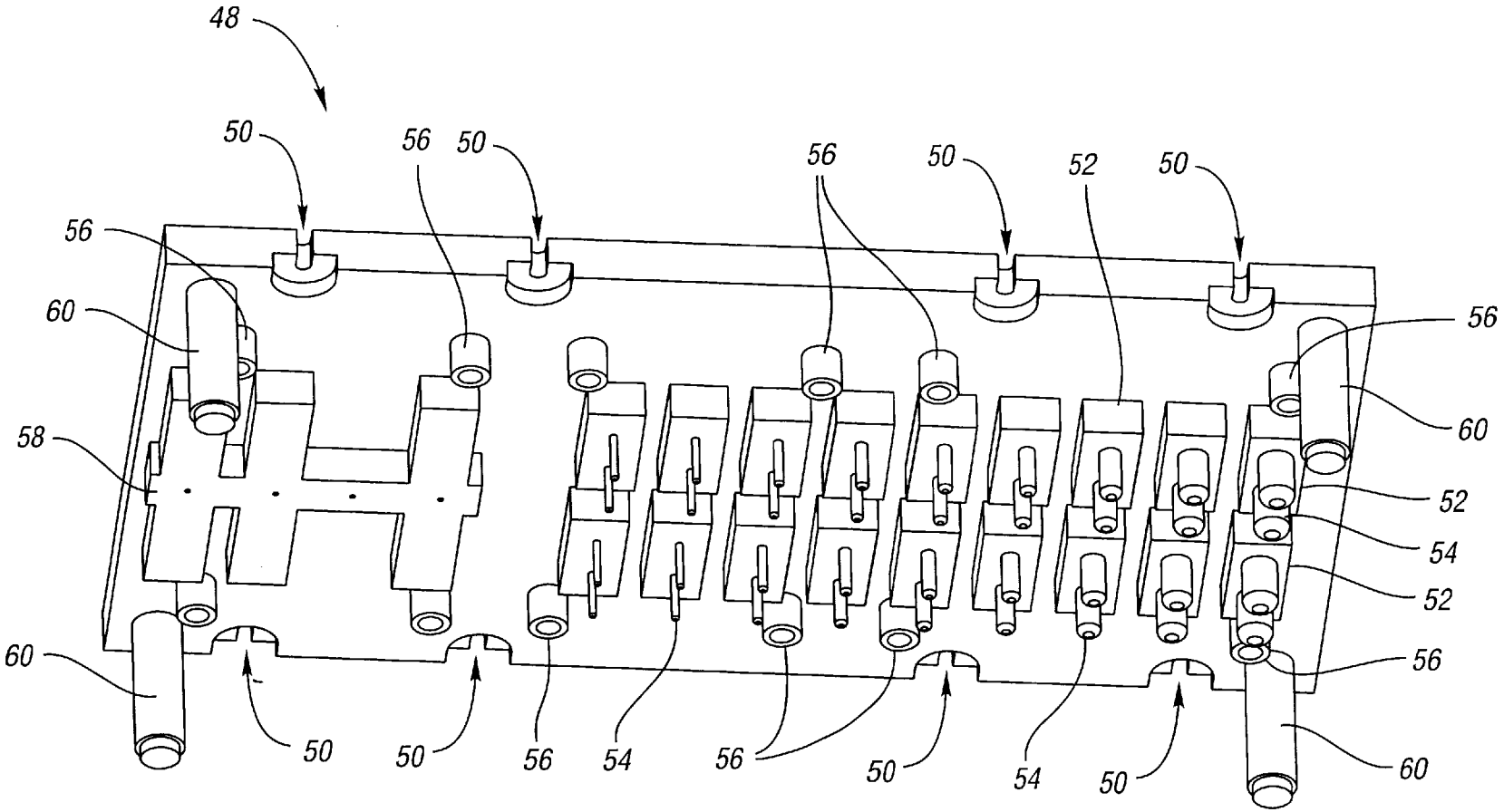
FIG. 3 shows a perspective view of an upper portion of the extrusion die sub-assembly.
Figure 4:
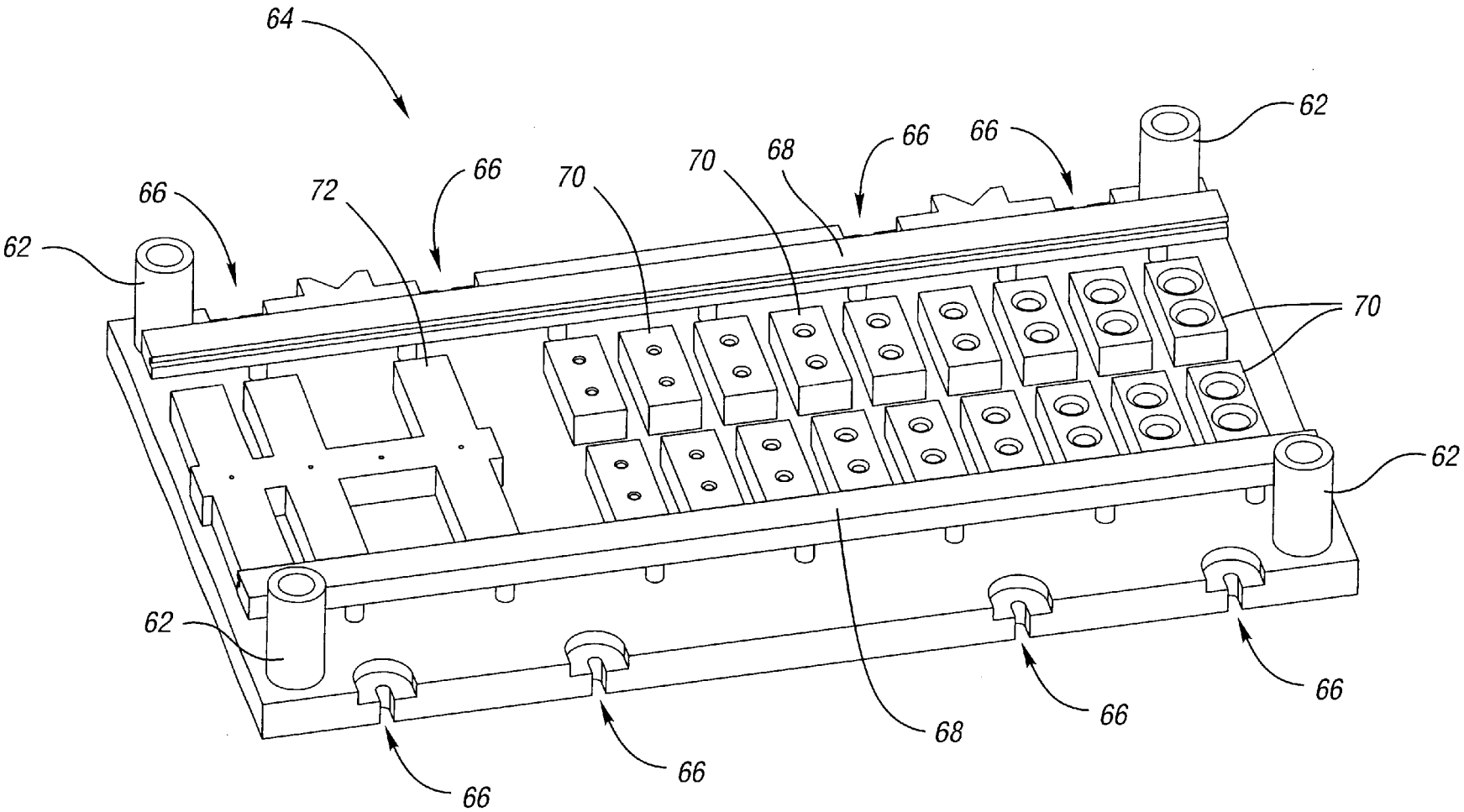
FIG. 4 shows a perspective view of a lower portion of the extrusion die sub-assembly.

FIG. 3 shows the upper portion 48 of the extrusion die subassembly 38. In this view the upper portion 48 is shown detached from the upper shoe 16. Typically the upper portion 48 is bolted to the upper shoe 16 at bolt locations 50. The upper portion 48 includes a plurality of punch retainers 52 which retain progressively sized punches 54. Bushings 56 acts as guides for the nitrogen cylinders 24 in the upper shoe 16. During the extrusion process the workpiece 44 may adhere to the punches 54 such that a stripping operation is required. The nitrogen cylinders 24 actuate a series of stripper pins 55, shown in FIG. 2, which are used to help remove the workpiece 44 from the punches 54. A stripper plate 57, also shown in FIG. 2, is attached to the stripper pins 55 and contacts the workpiece 44 with a downward force provided by the nitrogen cylinders 24 such that the workpiece 44 is cleanly removed from the punches 54.

The upper portion 48 of the extrusion die sub-assembly 38 includes additional tooling 58 that is located near the far end of the extrusion die subassembly 38. The additional tooling 58 may or may not be utilized depending on the extrusion configuration of the particular part being manufactured. If the additional tooling 58 is needed, it is easily modified to accommodate a variety of different finished part configurations. Each of the four corners of the upper portion 48 includes a guide pin 60. The guide pins 60 cooperate with guide bushings 62 which are located at the four corners of the lower portion 64 of the extrusion die sub-assembly 38 shown in FIG. 4. The lower portion 64 is the counterpart to the upper portion 48 and together they form the extrusions in the workpiece 44. The lower portion 64 is attached to the lower shoe 26 with bolts (not shown) at bolt locations 66. The workpiece 44 moves through the extrusion die sub-assembly 38 along guide rails 68. The guide rails 68 are vertically spring loaded such that they accommodate some up and down movement; however, they are rigidly affixed horizontally, to insure that the workpiece 44 remains properly aligned as it progresses through the extrusion die sub-assembly 38.

The extrusion process is accomplished when the ram 12 of the press 10 moves the upper portion 48 down onto the workpiece 44 such that the punches 54 force some of the workpiece material into draw bushings 70 located on the lower portion 64. The draw bushings 70 are progressively sized along the length of the lower portion 64, such that they compliment the punches 54 located in the upper portion 48. Additional tooling 72 is also provided in the lower portion 64 to compliment the additional tooling 58 located in the upper portion 48. Use of the additional tooling 72 is dependent on the configuration of the finished part being manufactured, and the additional tooling 72 is easily modified to accommodate a variety of finished part configurations. As the extrusions are progressively stamped into the workpiece 44, the workpiece material has a tendency to remain inside the draw bushings 70, especially near the end of the extrusion process. That is why the nitrogen cylinders 34 are located in the lower shoe near the last of the draw bushings 70. The nitrogen cylinders 34 force pins 74, shown in FIG. 2, back up through the draw bushings 70 to eject the workpiece 44.

Figure 5:
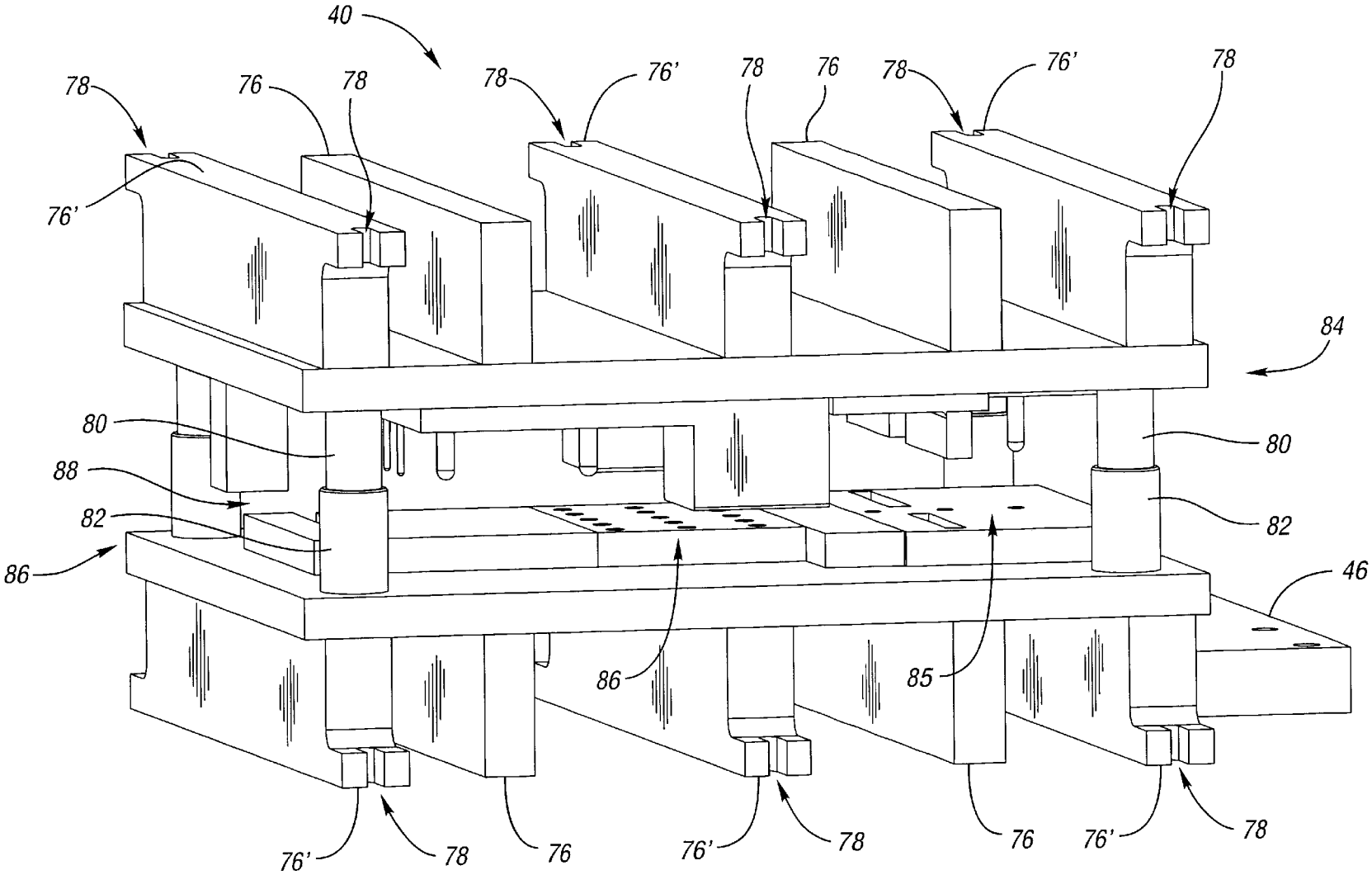
FIG. 5 shows a perspective view of the component die subassembly.

Once the workpiece 44 has left the extrusion die sub-assembly 38 it is a preform ready to be received by the component die sub-assembly 40. Shown in detail in FIG. 5, the component die sub-assembly 40 includes vertical support portions 76 and 76'. The vertical support portions 76' include bolt locations 78 for mounting the component die sub-assembly 40 to the ram 12 and the bolster plate 14 of the press 10. Like the extrusion die sub-assembly 38, the component die subassembly 40 has guide pins 80 and guide bushings 82 to assist in the cooperation between the upper portion 84 and the lower portion 86 of the component die subassembly 40. The alignment bar 46 is welded to one of the vertical support portions 76' on the lower portion 86 of the component die sub-assembly 40. The alignment bar 46 cooperates with locating pins 36 to insure that the two die sub-assemblies are properly aligned when they are mounted on the press 10.

Figure 7:
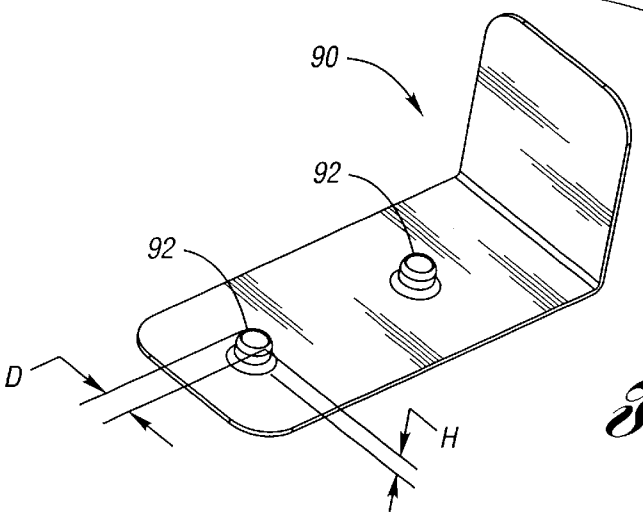
FIG. 7 shows a perspective view of a finished part after the extrusion and forming is complete.

The elements of the component die sub-assembly 40 that form the workpiece 44 into the finished part 90, shown in FIG. 7, are representative of a typical component die sub-assembly. However, it should be noted that these elements will change for any given finished part. Returning to FIG. 5, the workpiece 44 goes through three stages as it is progressively formed in the component die sub-assembly 40. In the first stage, piercing and trimming tooling 85 punctures and removes material from the workpiece 44 so that it is properly formed by forming tools 86 in the second stage of the process. Finally, the workpiece 44 reaches cut-off tooling 88 where the finished part is severed from the remainder of the workpiece 44.

Figure 6:
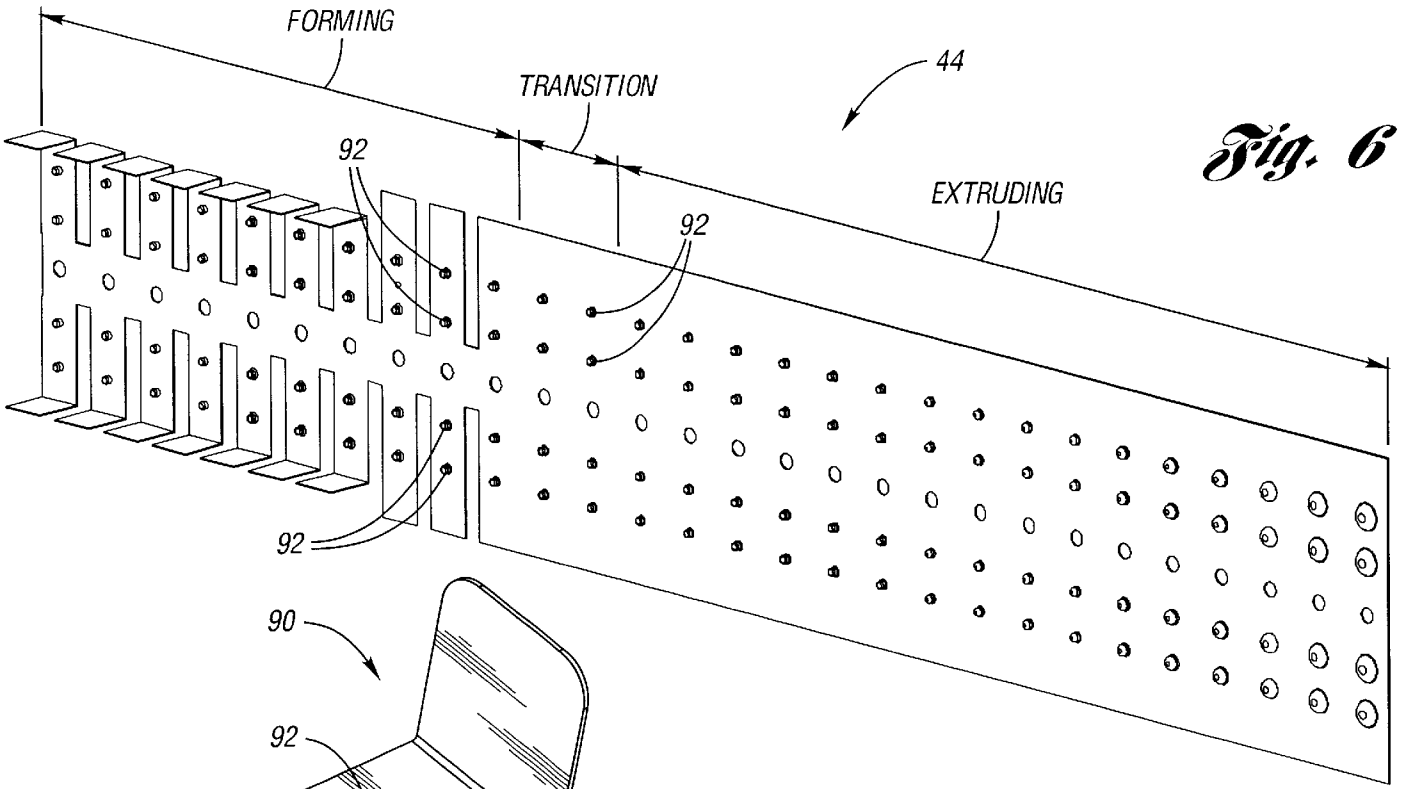
FIG. 6 shows a perspective view of the workpiece progressively extruded and formed to make successive pairs of finished parts.

FIG. 6 shows the workpiece 44 progressively extruded and formed to make successive pairs of finished parts 90. For clarity, the workpiece 44 is shown on its side, though in the process described above, the extrusions are formed downward as the punches 54 force material into the draw bushings 70. The workpiece 44, shown in FIG. 6, has three distinct areas. The first is the extruding area, showing the extrusions as they are progressively formed. The second area is a relatively short length where the workpiece is between the extrusion die subassembly 38 and the component die sub-assembly 40. Last is the forming area, which shows the workpiece 44 as it is cut and formed into the finished part 90. FIG. 7 shows the finished part 90 after the extrusion and forming is complete. The component die sub-assembly 40 forms the finished part 90 and cuts it to its final size. Hence, the only remaining operation is the threading of the extrusions 92 which allows the finished part 90 to be bolted into its assembled position without the use of external fasteners.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of doing business in a stamping facility whereby net costs are lowered for the stamping facility and its customers, comprising:

capitalizing an upper shoe attached to a moveable ram of a press and capable of cooperating with replaceable die sub-assemblies;

capitalizing a lower shoe attached to a bolster plate opposite the movable ram on the press, and capable of cooperating with the die sub-assemblies;

standardizing extrusion configurations and inventorying a plurality of different components adapted to make such configurations, and publishing such configurations for pre-selection by a customer in designing a finished part;

assembling an extrusion die sub-assembly using at least some of the inventoried components, and replaceably attaching the extrusion die sub-assembly to the upper and lower shoes for extruding the workpiece into a preform for the finished part;

assembling a component die sub-assembly based on the customer's finished part specifications, and replaceably attaching it to the ram and bolster plate of the press in a position to receive the preform from the extrusion die sub-assembly; and manufacturing the customer's finished part by feeding the workpiece into the stamping press and first extruding it into the preform with the extrusion die sub-assembly, and then forming it into the finished part with the component die sub-assembly.

2. The business method claim 1, wherein publishing extrusion configurations comprises publishing dimensional data and performance data of the extrusion configurations.

3. The business method of claim 1, further comprising giving the customers incentives to use the standardized extrusion configurations.

4. The business method of claim 1, further comprising attaching the component die sub-assembly to the extrusion die sub-assembly for removal from the stamping facility by the customer.

5. The business method of claim 1, wherein the standardized extrusion configurations are configured to accommodate internal threads.

6. The business method of claim 2, wherein the published dimensional data of the extrusion configurations includes an extrusion height.

7. The business method of claim 2, wherein the published dimensional data of the extrusion configurations includes an extrusion diameter.

8. The business method of claim 2, wherein the published performance data of the extrusion configurations includes an extrusion strength.

* * * * *